US005713061A

United States Patent [19]

Yoshioka

[11] Patent Number: 5,713,061

[45] Date of Patent: Jan. 27, 1998

[54] IMAGE FORMING APPARATUS HAVING PAGE DESIGNATION MEANS

[75] Inventor: Yoshiki Yoshioka, Osaka, Japan

[73] Assignee: Mita Industrial Co., Ltd., Osaka, Japan

[21] Appl. No.: 588,612

[22] Filed: Jan. 19, 1996

[30] Foreign Application Priority Data

Mar. 6, 1995 [JP] Japan ..... 7-045984

[51] Int. Cl.[6] ..... G03G 15/04

[52] U.S. Cl. ..... 399/38; 399/82; 399/364; 399/374

[58] Field of Search ..... 355/313, 319, 355/320, 325; 271/3.01, 3.14, 4.01, 10.01; 399/374, 364, 38, 82

[56] References Cited

U.S. PATENT DOCUMENTS 4,974,035 11/1990 Rabb et al. ..... 355/320

5,107,338 4/1992 Saito ..... 355/325 X 5,489,969 2/1996 Soler et al. ..... 355/325 X

*Primary Examiner*—Robert Beatty

*Assistant Examiner*—Sophia S. Chen

*Attorney, Agent, or Firm*—Beveridge, DeGrandi, Weilacher & Young, LLP

[57] ABSTRACT

An image forming apparatus for performing a one-side image formation to form an image of a designated page on a recording sheet is disclosed. Selected from a plurality of pages each carrying an image to be formed, a page can be designated by an operation section. Image formation on one side of a recording sheet carrying an image of the designated page formed on the other side thereof is prohibited. Thus, the recording sheet carries the image of the designated page formed only on one side thereof. Where images on two-sided document original sheets are copied to prepare a set of document copies, for example, one-side image formation is performed to copy an image on a cover sheet or on an inter-sheet for chaptering, while two-side image formation is performed to copy images of the other pages on normal sheets.

15 Claims, 17 Drawing Sheets

TWO-SIDE COPY MODE SELECTED

IMAGE FORMING APPARATUS HAVING PAGE DESIGNATION MEANS

BACKGROUND OF THE INVENTION

1. Field of the Invention

The present invention relates to an image forming apparatus such as a copying machine and, more particularly, to an image forming apparatus capable of forming images on normal paper sheets for image formation (hereinafter referred to simply as "normal sheets"), cover sheets such as of thick paper, or inter-sheets such as of colored paper to finally provide sets of image-carrying sheets.

2. Description of Related Art

Conventionally, copying machines are widely available which are adapted to optically scan a document original, form an electrostatic latent image corresponding to the scanned original image on a photoreceptor, develop the electrostatic latent image into a toner image, and transfer the toner image onto a normal sheet. Some of the copying machines have a plurality of image formation modes including a one-side copy mode for making a copy of an original document image only on one side of a normal sheet, a two-side copy mode for making copies of original document images on the both sides of a normal sheet, and a sheet mode.

The sheet mode is designed to allow a finally obtained set of document copies (hereinafter referred to simply as "document copy set") to have a smart appearance, and includes a cover mode and an inter-sheet mode. The cover mode is designed to attach a cover sheet such as of thick paper different from a normal sheet as a front cover or back cover of the document copy set. The-inter-sheet mode is designed to insert an inter-sheet such as of colored paper different from the normal sheet in a desired portion of the document copy set, e.g., at the beginning of a chapter of a document. The cover sheet and inter-sheet are set on a sheet feeding deck separately from normal sheets.

A copying machine having the sheet mode can selectively perform the following first and second operations by designating the cover mode or the inter-sheet mode along with the two-side copy mode. More specifically, in the first operation, a cover sheet or inter-sheet carrying original images copied on the both sides thereof is attached onto or interleaved between normal sheets. In the second operation, a cover sheet or inter-sheet carrying no image formed thereon is attached onto or interleaved between normal sheets.

When the copying machine is in the two-side copy mode, it is desirable to perform one-side image formation on a cover sheet so that the cover sheet carries an image such as of a title of the document formed only on one side thereof to allow the resulting document copy set to have a smart appearance. Similarly, it is desirable that an inter-sheet carries an image such as of a chapter introduction formed only on one side thereof. By copying the title or each chapter introduction of the document on one side of the cover sheet or inter-sheet while copying the text of the document on the both sides of normal sheets, the appearance of the resulting document copy set could be improved.

However, the conventional copying machine is only capable of performing either one of the first or second operations. For example, it is herein assumed that original images on two-sided document original sheets including a title printed on page 1 and a chapter introduction printed on page 7 as shown in FIG. 9A are to be copied. Where the copying machine performs the first operation, two-side image formation is performed so that a cover sheet and an inter-sheet each carry images formed on the both sides thereof as shown in FIG. 9B. On the other hand, where the copying machine performs the second operation, image formation is not performed on a cover sheet nor on an inter-sheet. Therefore, a document copy set of smart appearance cannot be obtained.

SUMMARY OF THE INVENTION

It is an object of the present invention to provide an image forming apparatus capable of preparing a set of image-carrying sheets which includes a sheet carrying an image of a predetermined page formed only on one side thereof.

It is another object of the present invention to provide an image forming apparatus capable of preparing a set of image-carrying sheets of smart appearance by a simple user's operation.

In accordance with the present invention, an image forming apparatus includes page designation means for designating a page selected from a plurality of document original pages each carrying an image to be formed. Image formation on one side of a recording sheet carrying an image of the designated page formed on the other side thereof is prohibited. Thus, the recording sheet carries the image of the designated page formed only on one side thereof.

The page designation means is preferably capable of designating the first page selected from the plurality of document original pages. Thus, a front cover can be attached to a set of image-carrying sheets. Since the front cover carries no image on the back side thereof, the appearance of the resulting image-carrying sheet set can be improved.

The page designation means is preferably capable of designating the last page selected from the plurality of document original pages. Thus, a back cover can be attached to the set of image-carrying sheets. Since the back cover carries no image on the back side thereof, the appearance of the resulting image-carrying sheet set can be improved.

The page designation means is preferably capable of designating any of middle pages selected from the plurality of document original pages. Where an image of each chapter introduction in a chaptered document is formed on a recording sheet which is to be inserted before the beginning of a corresponding chapter, for example, the recording sheet carries no image on the back side thereof and, thus, has a smart appearance.

The page designation means is preferably capable of designating a plurality of pages. Where original images of a document comprising a plurality of chapters are formed on recording sheets, for example, the appearance of the resulting image-carrying sheet set can be improved.

When the image formation is performed, either a sheet of a first type or a sheet of a second type is preferably selected and fed to an image forming section as a recording sheet on which an image is to be formed. Where an original image of a page other than the page designated by the page designation means is to be formed, a sheet of the first type is preferably fed to the image forming section. Where an original image of the designated page is to be formed, a sheet of the second type is preferably fed to the image forming section.

Thus, the front cover, back cover and pages to be inserted at chapter beginning portions can be formed of sheets of a type different from that of sheets on which images of the other pages are to be formed. Therefore, the appearance of the resulting image-carrying sheet set can be improved.

The image forming apparatus may be adapted to designate a two-side mode for forming images on the both sides of a recording sheet and image formation on one side of a sheet of the second type. In this case, image formation on one side of a recording sheet carrying an image of the page designated by the page designation means on the other side thereof is preferably prohibited, if the two-side mode and image formation on one side of a sheet of the second type are designated.

Therefore, a user can designate image formation on one side of a cover sheet or an inter-sheet (sheet of the second type) by a simple operation. This can alleviate a burden to the user to improve the user interface.

As described above, the second type sheet may be a cover sheet to be attached as the first page or the last page of the set of image-carrying sheets, or an inter-sheet to be inserted to a middle page portion of the set of image-carrying sheets.

Images of pages other than the page designated by the page designation means may be formed on both sides of recording sheets. Since the image of the designated page is formed only on one side of a recording sheet, the appearance of the resulting image-carrying sheet set can be improved.

The image forming section may be adapted to form images of the plural pages of the original document on recording sheets in the descending order from the last page. In this case, image formation on one side of a recording sheet carrying an image of the last page of the original document formed on the other side thereof is preferably prohibited.

For example, it is herein assumed that an image of page 1 of an original document comprised of a plurality of two-sided image-carrying sheets is to be formed on one side of a cover sheet as shown in FIG. 8A. In this case, images of the subsequent pages of the document are formed on the both sides of recording sheets by shifting the subsequent pages backward by one page as shown in FIG. 8B. As a result, an image of the last page of the document is formed on one side of a recording sheet and, therefore, the image formation on the other side of the recording sheet should be prohibited.

Further, image formation on one side of a recording sheet carrying an image of a page just before the page designated by the page designation means on the other side thereof is preferably prohibited.

For example, it is herein assumed that images of page 3 (a first designated page) and page 7 (a second designated page) of an original document comprised of a plurality of two-sided image-carrying sheets are to be each formed on one side of an inter-sheet as shown in FIG. 8A. In this case, images of page 4 (the back side page of page 3) and subsequent pages (page 5 to page 10) are to be formed on normal sheets by shifting the subsequent pages backward by one page as shown in FIG. 8C. As a result, an image of page 6 just before the second designated page (page 7) is formed on one side of a recording sheet and, therefore, the image formation on the other side of the recording sheet should be prohibited.

The image forming apparatus may be a copying machine. In this case, the image forming apparatus may include a document original sheet feeder for successively presenting the front side and back side of each document original sheet to a document original presentation portion.

The foregoing and other objects, features and effects of the present invention will become more apparent from the following detailed description of preferred embodiments with reference to the attached drawings.

DESCRIPTION OF PREFERRED EMBODIMENTS

Figure 1:
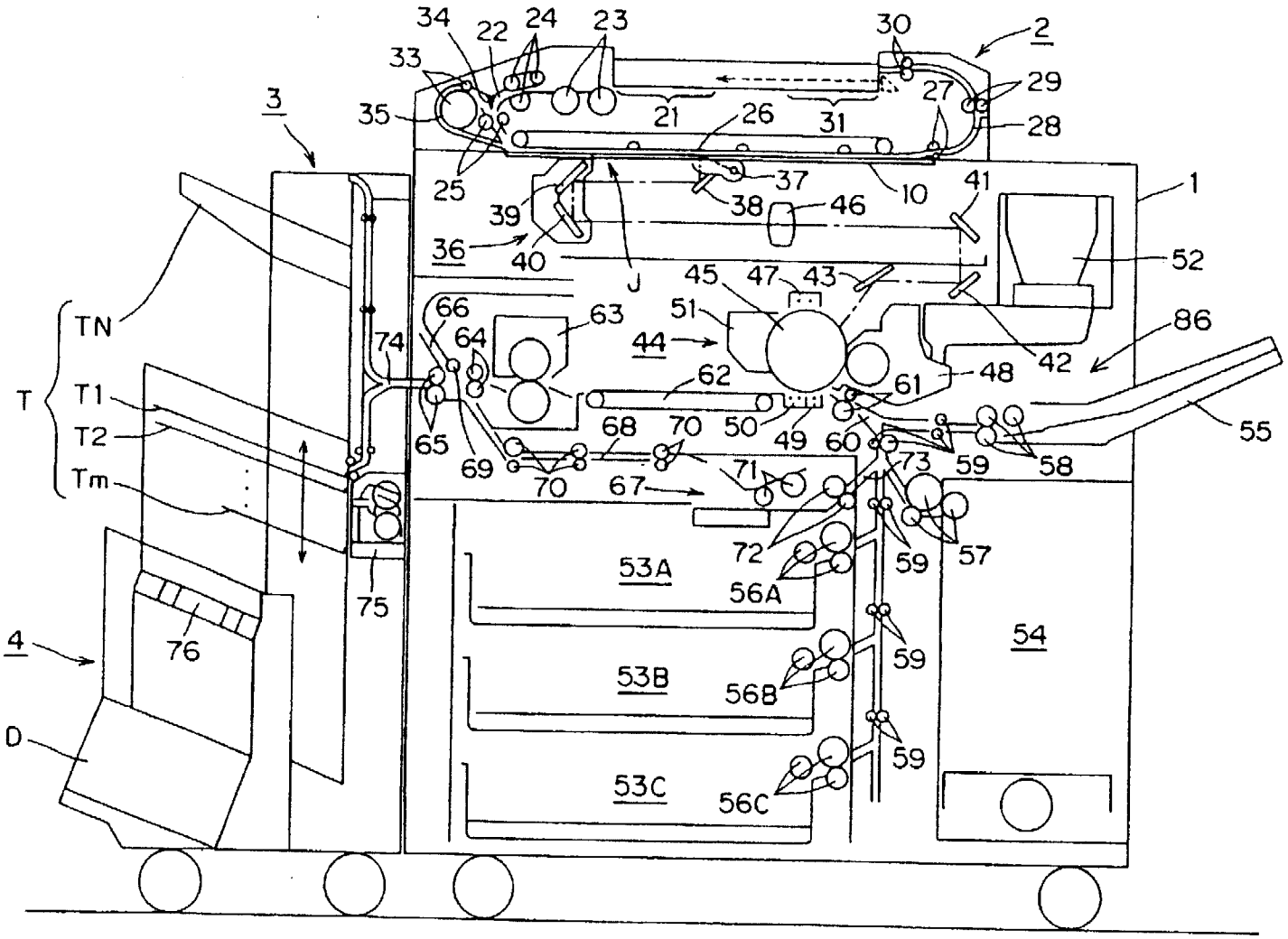
FIG. 1 is a schematic diagram illustrating an exemplary construction of a copying machine which is an image forming apparatus in accordance with one embodiment of the present invention.

FIG. 1 is a schematic diagram illustrating an exemplary construction of a copying machine which is an image forming apparatus in accordance with one embodiment of the present invention. The copying machine has a copying machine body 1, an automatic document original sheet feeder (hereinafter referred to as "RDH") 2 disposed on a top surface of the copying machine body 1, sorter 3 for sorting and discharging copy sheets from the copying machine body 1 into a plurality of bins TN, T1, T2, . . . , Tm (hereinafter generally referred to as "bins T"), and a stacker 4 for collecting and stacking the copy sheets discharged to the bins T in a stack section D.

On the top surface of the copying machine 1 is disposed a transparent document original platform 10 serving as a document original presentation portion. When a copying operation is performed, a document original sheet is placed in an image formation position (light exposure position) J. Where an image on a one-sided document original sheet is to be copied, the document original sheet is placed in the image formation position J on the document original platform 10 with the front side thereof facing downward. Where images on a two-sided document original sheet are to be copied, the document original sheet is placed in the image formation position J on the document original platform 10 with either the front side or the back side thereof facing downward.

The RDH 2 automatically feeds a document original sheet to the image formation position J on the document original platform 10. The RDH 2 includes sheet feeding rollers 23, 24 and 25, and a transportation belt 26, by means of which document original sheets set in a document original sheet setting position 21 are taken out one by one from the bottom side thereof, and fed to the image formation position J through a sheet feeding path 22 extending to the document original platform 10.

The RDH 2 further includes reversing rollers 33 for reversing a two-sided document original sheet after an image on one side of the document original sheet is copied and feeding the document original sheet to the image formation position J. The reversing rollers 33 are used where images on a two-sided document original sheet are copied on the both sides of a copy sheet in a two-side copy mode or where images on a two-sided document original sheet are respectively copied on two copy sheets in a separate copy mode. The two-sided document original sheet, after subjected to a one-side copying operation, is returned to the sheet feeding path 22 by the transportation belt 26. By reversing the rotation of the sheet feeding rollers 25 and blocking the sheet feeding path 22 by a separation claw 34, the document original sheet is introduced to a reversion path 35. The document original sheet is transported through the reversion path 35 by the rotation of the reversing rollers 33 and led to the image formation position J.

The document original sheet on the document original platform 10 is transported by the transportation belt 26. The document original sheet after being subjected to the copying operation is led to a sheet discharging path 28 by sheet discharging rollers 27, and discharged to a document original sheet discharging position 31 through relay rollers 29 and sheet discharging rollers 30. After the document original sheets set in the document original sheet setting position 21 are all discharged to the document original sheet discharging position 31, these document original sheets are automatically set again in the document original sheet setting position 21.

A document original reading section 36 is disposed in the copying machine body 1. The document original reading section 36 has a light source 37 for irradiating and scanning a document original sheet presented to the image formation position J on the document original platform 10. The light source 37 is reciprocally driven along the document original platform 10 in a transverse direction of FIG. 1 by a driving force from an optical system motor not shown. Light emitted from the light source 37 is reflected on the document original presented to the image formation position J. The light reflected on the document original is further reflected on a first reflection mirror 38 driven unitedly with the light source 37, and further reflected on a second reflection mirror 39, a third reflection mirror 40, a fourth reflection mirror 41, a fifth reflection mirror 42 and a sixth reflection mirror 43 to be led to a photoreceptor drum 45 in an image formation section 44.

The second reflection mirror 39 and third reflection mirror 40 are driven in a transverse direction of FIG. 1 at a speed one half a speed at which the light source 37 is driven. Thus, the optical path length from the light source 37 to the photoreceptor drum 45 is always kept constant during the scanning of the document original by the light from the light source 37. Between the third reflection mirror 40 and the fourth reflection mirror 41 is disposed a zoom lens 46 for forming a document original image on the photoreceptor drum 45.

The image formation section 44 includes the aforesaid photoreceptor drum 45 rotatively driven at a constant speed during the copying operation, and a main charger 47, a developing unit 48, a transfer charger 49, a separation charger 50 and a cleaning unit 51 which are disposed around the photoreceptor drum 45 in this order in a rotational direction.

After uniformly being charged by the main charger 47, the surface of the photoreceptor drum 45 is exposed to the light reflected from the document original. As a result, an electrostatic latent image corresponding to a reversed document original image is formed on the surface of the photoreceptor drum 45. The electrostatic latent image is developed into a toner image with toner supplied from a toner hopper 52 in the developing unit 48. The toner image is transferred onto a copy sheet by the transfer charger 49. After the transfer of the toner image, residual toner present on the surface of the photoreceptor drum 45 is removed by the cleaning unit 51. The separation charger 50 serves to separate the copy sheet from the surface of the photoreceptor drum 45. The main charger 47, the transfer charger 49 and the separation charger 50 perform their respective functions by corona discharging.

In synchronization with the image formation in the image formation section 44, a sheet is fed from an upper deck 53A, a middle deck 53B, a lower deck 53C, a large volume deck 54 or a manual sheet feeding tray 55 by means of a sheet transportation system 86 (corresponding to recording sheet feeding means). The upper deck 53A, the middle deck 53B and the lower deck 53C respectively accommodate paper sheets of normal thickness (hereinafter referred to as "normal sheets") having different sizes. The large volume deck 54 accommodates a large amount of normal sheets of a size which are to be frequently used. The manual sheet feeding tray 55 is used to feed sheets other than the aforesaid normal sheets, e.g., special sheets including normal sheets preliminarily formatted, cover sheets such as of thick paper and inter-sheets such as of colored paper.

The sheet transportation system 86 includes sheet feeding rollers 56A, 56B, 56C, 57 and 58. These sheet feeding rollers are respectively disposed in positions relative to the upper deck 53A, the middle deck 53B, the lower deck 53C, the large volume deck 54 and the manual sheet feeding tray 55 for taking out the normal sheets or the special sheets one by one. During the copying operation, the sheet feeding rollers 56A, 56B, 56C, 57 or 58 are rotatively driven, thereby taking out a normal sheet or a special sheet from corresponding one of the upper deck 53A, the middle deck 53B, the lower deck 53C, the large volume deck 54 and the manual sheet feeding tray 55. The sheet thus taken out is introduced to a sheet transportation path 60 extending to the vicinity of the photoreceptor drum 45 by the relay rollers 59.

A pair of registration rollers 61 are disposed adjacent to the photoreceptor drum 45 on the sheet transportation path 60. The registration rollers 61 once stop the normal sheet or special sheet thus transported, and then feed the sheet to the photoreceptor drum 45 in synchronization with the rotation of the photoreceptor drum 45. Thus, the sheet is fed to the photoreceptor drum 45 in a timing such that the sheet is registered with the toner image formed on the surface of the photoreceptor drum 45 at the position of the transfer charger 49.

The copy sheet (normal sheet or special sheet) carrying the toner image transferred thereon by the transfer charger 49 is separated from the surface of the photoreceptor drum 45 by the separation charger 50. The copy sheet thus separated is introduced to a fixation unit 63 by the transportation belt 62. The fixation unit 63 fixes the toner on the surface of the copy sheet. The copy sheet after being subjected to the fixation process is transported to the sorter 3 by transportation rollers 64 and sheet discharging rollers 65.

A copy sheet transportation path extending from the transportation rollers 64 to the sheet discharging rollers 65 is connected to a reversion path 66 for reversing the copy sheet subjected to the fixation process, and to an intermediate path 68 for transporting the copy sheet to an intermediate tray 67 disposed in a central portion of the copying machine body 1. Along the intermediate path 68 are disposed appropriately-spaced transportation rollers 70. The intermediate tray 67 is used when the two-side copy mode or the separate copy mode is implemented.

The copy sheet after being subjected to the fixation process is once introduced to the reversion path 66 by a separation claw not shown and a reversion roller 69, and then led to the intermediate path 68 by the reverse rotation of the reversion roller 69 to be accommodated in the intermediate tray 67. Copy sheets accommodated in the intermediate tray 67 are taken out one by one by the sheet feeding rollers 71 and 72, then introduced to the transportation path 73 joining the sheet transportation path 60, and led again to the photoreceptor drum 45 through the sheet transportation path 60.

The sorter 3 has the plurality of bins T, as described above. The copy sheet discharged by the sheet feeding rollers 65 is introduced to a sheet discharging path 74 and then led to a predetermined bin T by a sorting mechanism not shown. Of the plurality of bins T, the bin TN is a non-sort bin for receiving copy sheets which are not sorted after the copying operation. The bins T1 to Tm are sort bins for receiving copy sheets which are sorted after the copying operation.

The sorter 3 has a punch/staple unit 75 for punching a plurality of copy sheets led to the respective sort bins T1 to Tm or stapling the copy sheets by means of a stapler. The sort bins T1 to Tm are vertically movable, so that a sort bin Tm accommodating a set of copy sheets to be subjected to the punching or stapling process is moved to a position facing to the punch/staple unit 75.

The stacker 4 stacks the stack section D with sets of copy sheets each subjected to the stapling process in the punch/staple unit 75. The sets of copy sheets each subjected to the stapling process are taken out by means of a take-out device 76 in the stacker 4 and introduced to the stack section D.

Figure 2:
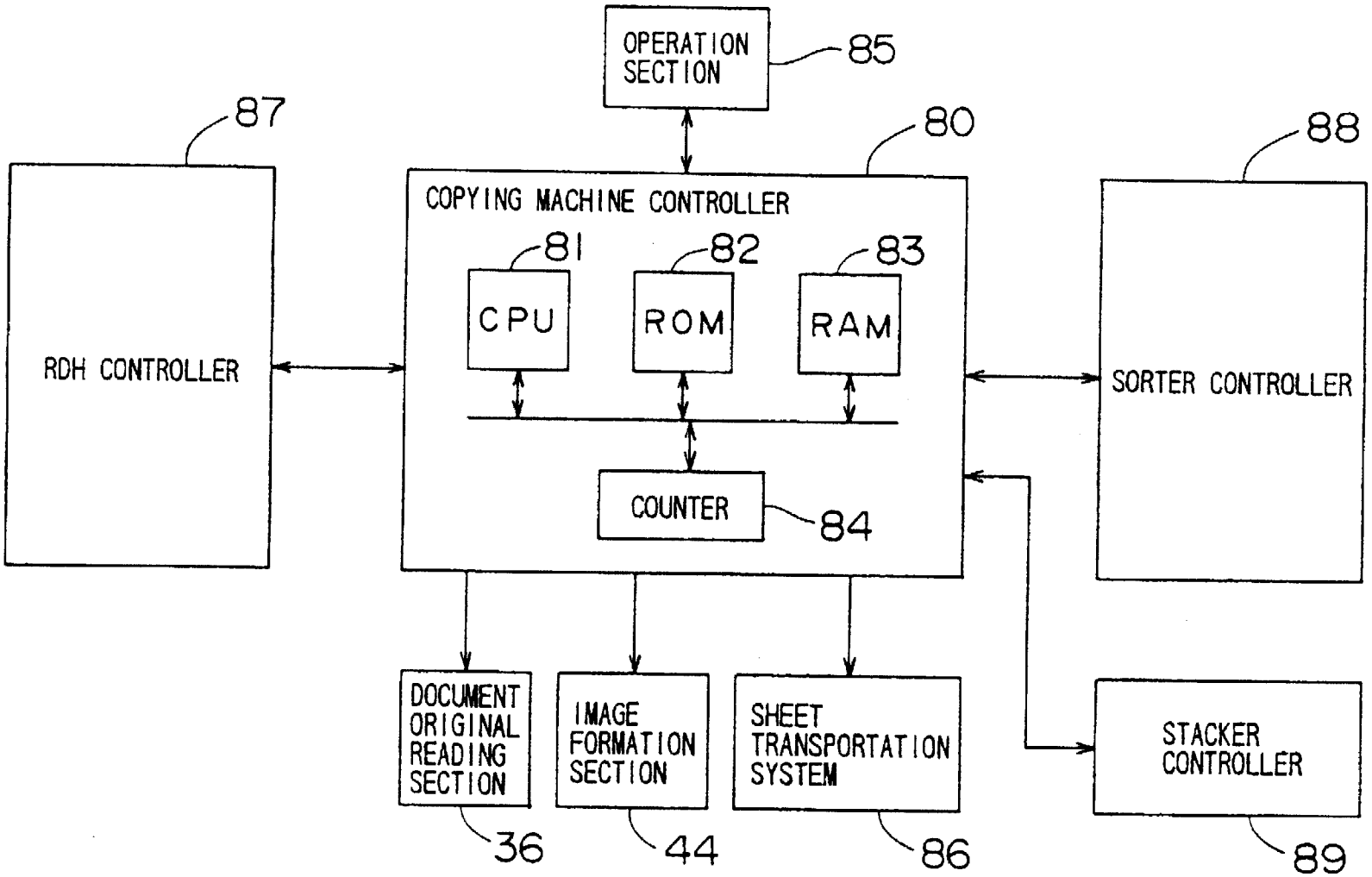
FIG. 2 is a block diagram illustrating the electrical construction of the copying machine.

FIG. 2 is a block diagram illustrating the electrical construction of the aforesaid copying machine. The document original reading section 36, image formation section 44, sheet transportation system 86 and the like provided in the copying machine body 1 are controlled by a copying machine controller 80. The copying machine controller 80 comprises a microcomputer including a CPU 81, a ROM 82, a RAM 83 and a counter 84. The CPU 81 operates in accordance with predetermined operational programs stored in the ROM 82 to control the respective components. The RAM 83 provides a work area for the CPU 81. The counter 84 is used to count document original pages subjected to the copying operation. The counter 84 may be a software-based counter in which the CPU 81 changes a count value stored in a counter area reserved in a predetermined area of the RAM 83. The copying machine controller 80 has an operation section 85 provided, for example, on a front side portion of the top face of the copying machine body 1.

The copying machine controller 80 is connected to an RDH controller 87, a sorter controller 88 and a stacker controller 89. The RDH controller 87 controls the operation of the RDH 2, and the sorter controller 88 controls the operation of the sorter 3. Similarly, the stacker controller 89 controls the operation of the stacker 4. The respective controllers 80, 87, 88 and 89 communicate with each other to coordinate the operations of the copying machine body 1, RDH 2, sorter 3 and stacker 4.

The RDH controller 87, sorter controller 88 and stacker controller 89 each comprise a microcomputer including a CPU, a ROM and a RAM, like the copying machine controller 80.

Figure 3:
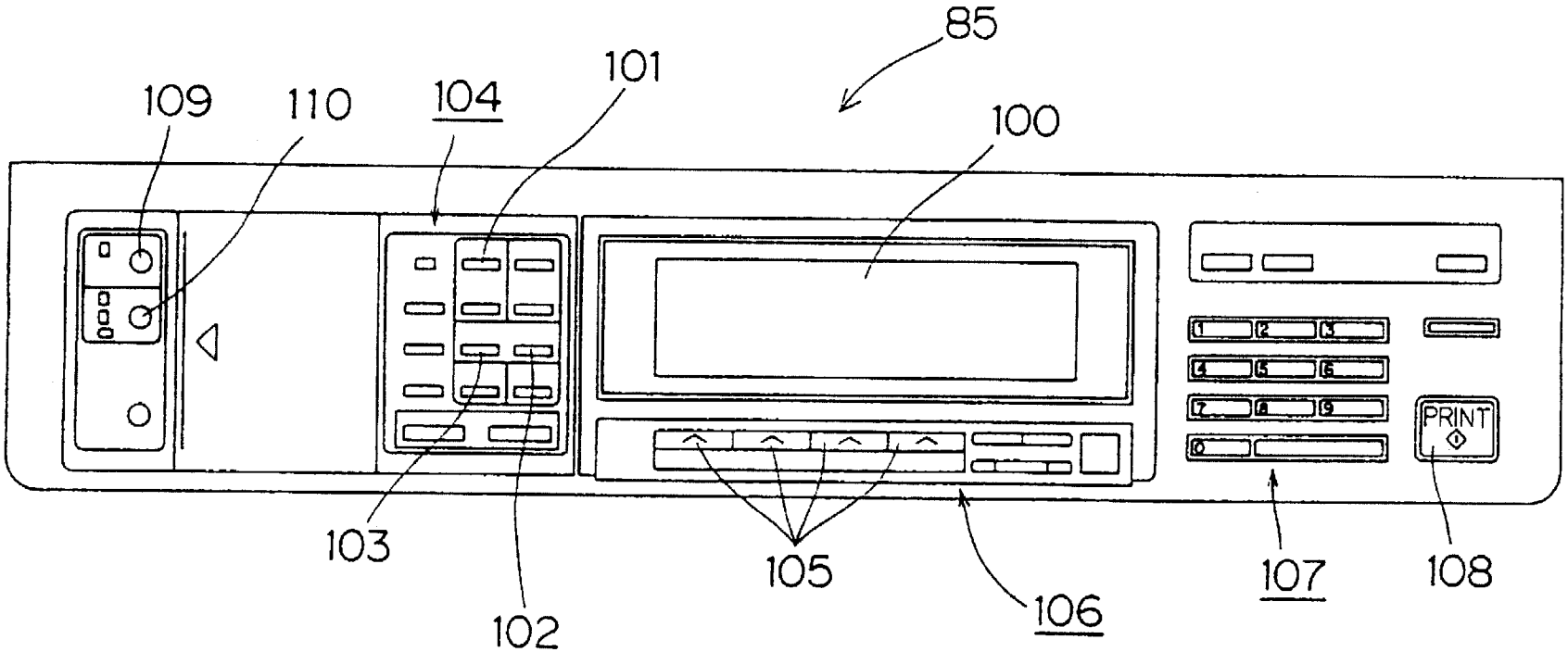
FIG. 3 is a plan view illustrating the external construction of an operation section of the copying machine.

FIG. 3 is a plan view illustrating the external construction of the operation section 85. The operation section 85 has a display section 100 such as of a liquid crystal display device (LCD) disposed in the central portion thereof. On the left side of the display section 100 in FIG. 3 is disposed a mode selection portion 104. The mode selection portion 104 includes a sheet/insert key 101 for a screen for causing the display section 100 to display the selection of the sheet mode, a two-side copy key 102 for designating the two-side copy mode when the sheet mode is not selected, and a separate copy key 103 for designating the separate copy mode when the sheet mode is not selected. The sheet mode includes a cover mode, an inter-sheet mode and a chapter mode. In the cover mode, a cover sheet is attached onto the front face or the back face of a set of document copies. In the inter-sheet mode, an inter-sheet is inserted in a desired portion, e.g., between chapters, of the copied document. In the chapter mode, an image of the first page of each chapter of the original document is forcibly copied on the front page of a copy sheet.

On the lower side of the display section 100 in FIG. 3 is disposed a mode setting portion 106. The mode setting portion 106 includes a plurality of mode setting keys 105 for selecting any of plural mode options displayed in the display section 100. The mode options are displayed in positions within the display section 100 corresponding to the respective mode setting keys 105. The respective mode options are selected by operating the mode setting keys 105 in the corresponding positions.

On the right side of the display section 100 in FIG. 3 are disposed ten keys 107 and a print key 108 for starting the copying operation. On the left side of the mode selection portion 104 in FIG. 3 are disposed a punch key 109 for the punching process, and a staple key 110 for the stapling process.

Figure 4A:
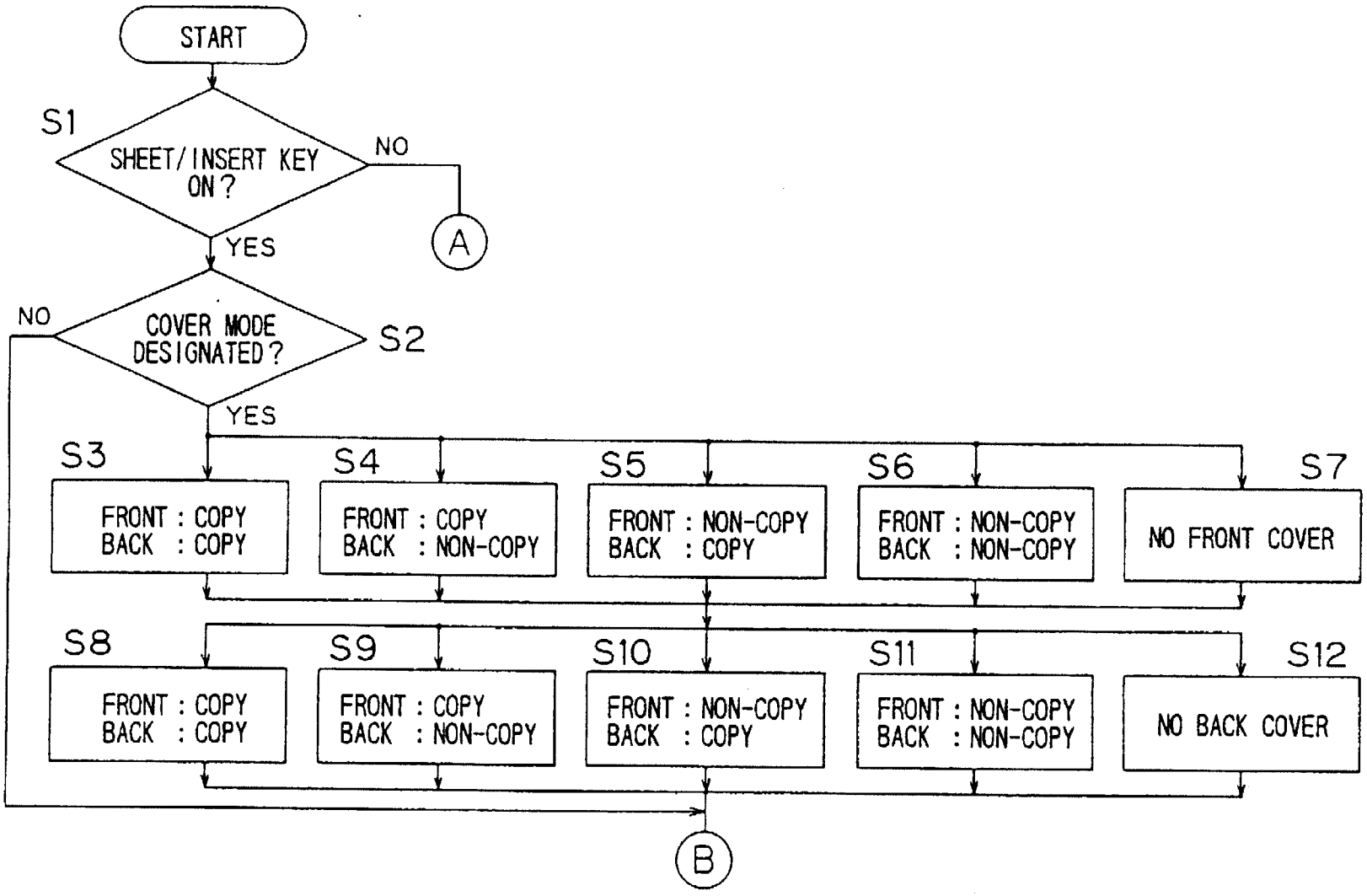
FIGS. 4A and 4B are flow charts for explaining the selection and setting of a sheet mode of the copying machine.
Figure 4B:
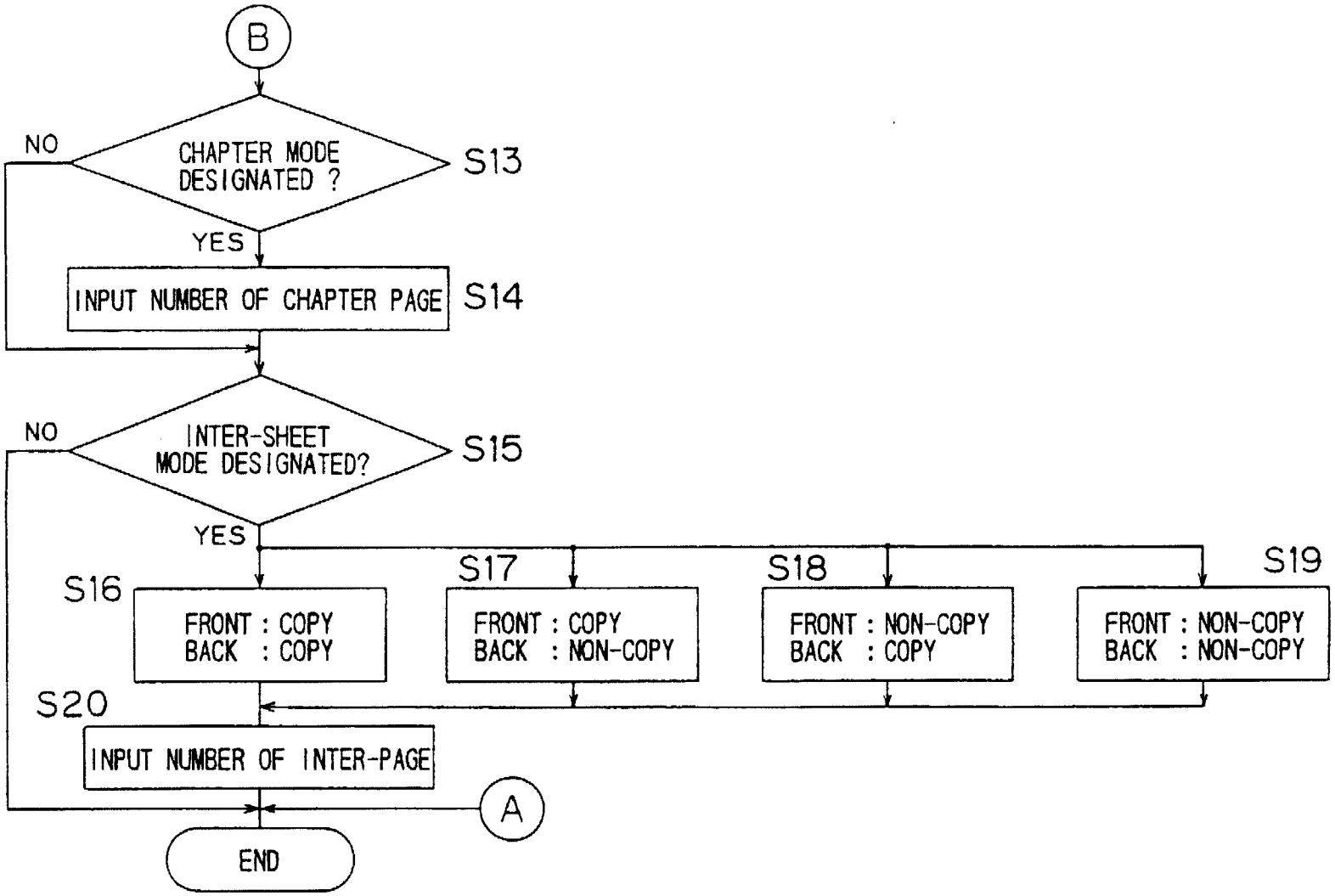

FIGS. 4A and 4B are flow charts for explaining an operation flow for selecting and setting the sheet mode. FIGS. 5A to 5M are diagrams for explaining various screen images to be displayed in the display section 100 in relation to the operation flow. The copying machine controller 80 controls the display section 100 for the switching of the screen images. More specifically, the CPU 81 performs a process for controlling the display section 100 in accordance with a predetermined program stored in the ROM 82.

Figure 5A:
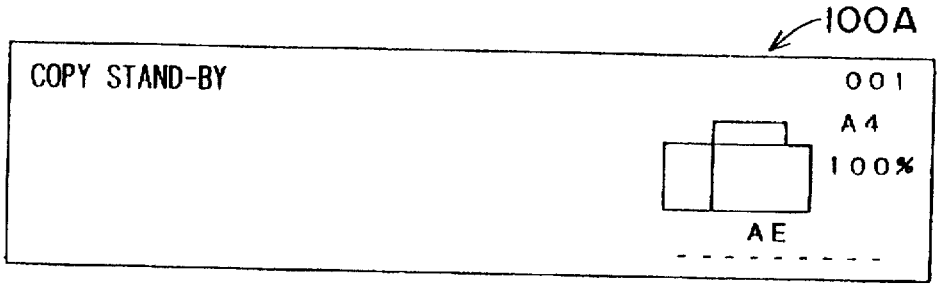
FIGS. 5A to 5M are diagrams for explaining various screen images to be displayed in a display portion for the mode setting operations in the sheet mode.
Figure 5B:
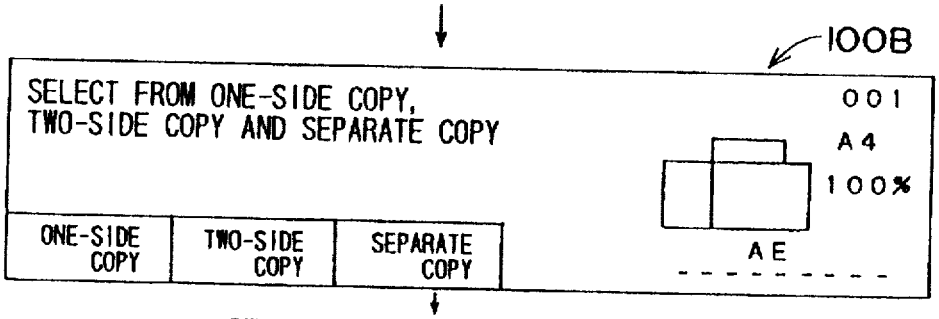

FIG. 5A shows a usual copy screen. When an operator manually operates the sheet/insert key 101 in a state where the usual copy screen image 100A is displayed in the display section 100 (Step S1 in FIG. 4A), a mode setting screen image 100B is displayed as shown in FIG. 5B. More specifically, a message of "SELECT FROM ONE-SIDE COPY, TWO-SIDE COPY AND SEPARATE COPY" and options of the one-side copy mode, the two-side copy mode and the separate copy mode are displayed in the display section 100.

Figure 5C:
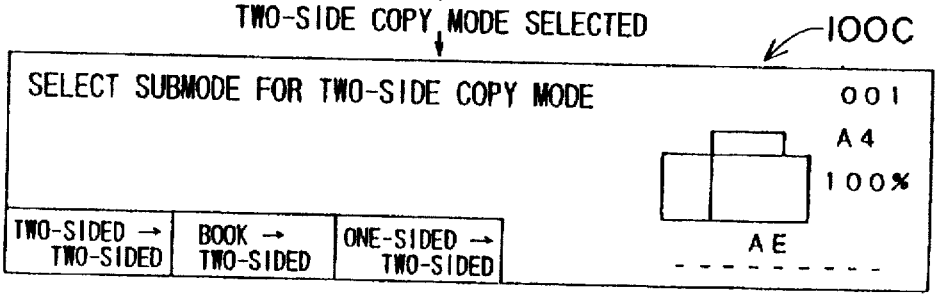

At this time, if the two-side copy mode is designated by pressing a corresponding mode setting key 105, for example, a two-side copy mode setting screen image 100C is displayed as shown in FIG. 5C. More specifically, a message of "SELECT SUBMODE FOR TWO-SIDE COPY MODE" is displayed in the display section 100. Further, three options are displayed, which include a submode for copying two-sided document originals on both sides of normal sheets, a submode for copying book-type document originals on both sides of normal sheets, and a submode for copying a plurality of one-sided document originals on both sides of normal sheets.

Figure 5D:
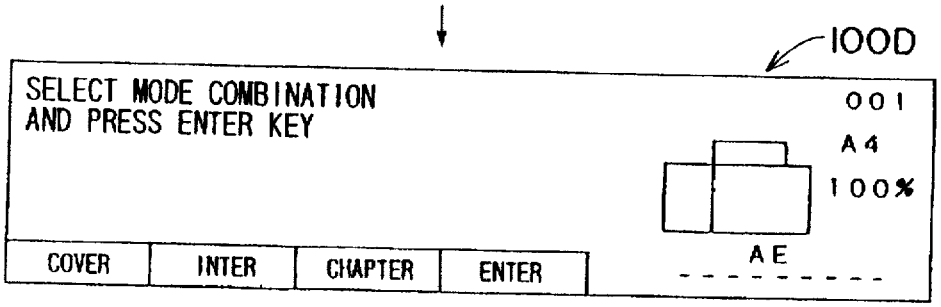

When the operator manually designates one of the options in the two-side copy mode setting screen, a sheet mode setting screen image 100D is displayed as shown in FIG. 5D. More specifically, a message of "SELECT MODE COMBINATION AND PRESS ENTER KEY" is displayed in the display section 100. Further, options of the cover mode, inter-sheet mode and chapter mode, and an indication of the enter key are displayed in the display section 100. In the sheet mode, not one mode but a plurality of modes can be simultaneously selected. The setting in the sheet mode is completed by operating a mode setting key 105 corresponding to the indication of "ENTER" in the screen.

It is herein assumed that the cover mode, the inter-sheet mode and the chapter mode are all designated in the sheet mode setting screen.

Figures 5E, 5F, 5G:
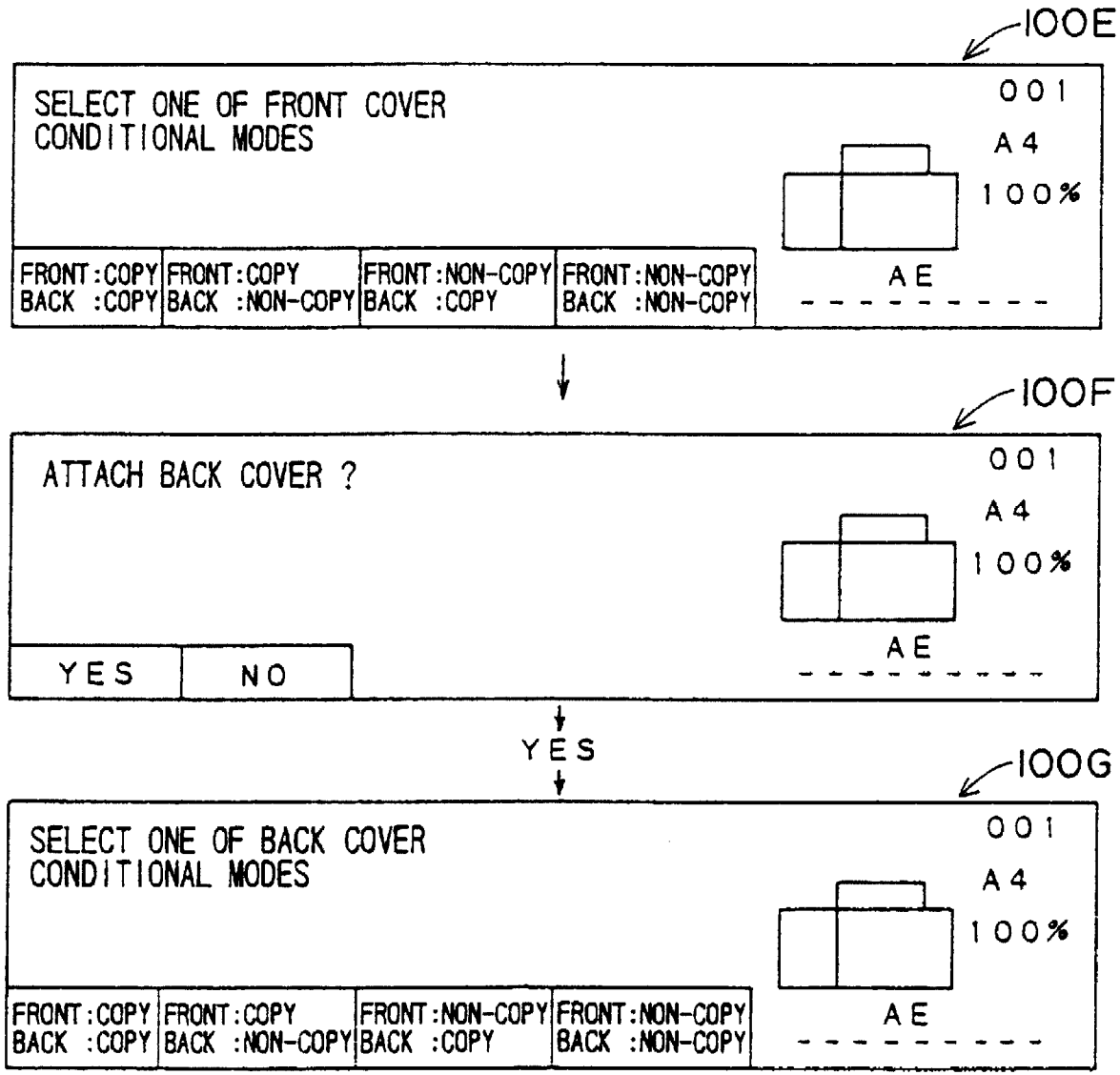

When the cover mode is designated in the sheet mode setting screen (Step S2 in FIG. 4A), a conditional mode setting screen image 100E is displayed as shown in FIG. 5E. More specifically, a message of "SELECT ONE OF FRONT COVER CONDITIONAL MODES" is displayed in the display section 100, and the operator is prompted to select image formation conditions for the front cover mode. In response thereto, the operator selects the image formation conditions for a cover sheet to be attached onto the front face of the document copy set (hereinafter referred to as "front cover sheet"). As shown in FIG. 5E, the image formation conditional modes include a mode for copying on the both sides of the front cover sheet (Step S3 in FIG. 4A), a mode for copying only on the front side of the front cover sheet (Step S4 in FIG. 4A), a mode for copying only on the back side of the front cover sheet (Step S5 in FIG. 4A), a mode for making no copy on either side of the front cover sheet (Step S6 in FIG. 4A). Step S7 in FIG. 4A corresponds to a case where the cover mode is not selected in the sheet mode setting screen shown in FIG. 5D.

When the operator selects any one of the modes in the conditional mode setting screen, a screen image 100F is displayed as shown in FIG. 5F for determining whether or not a cover sheet (hereinafter referred to as "back cover sheet") is to be attached onto the back face of the document copy set (Step S12 in FIG. 4A). More specifically, a message of "ATTACH BACK COVER SHEET?" and options of "YES" and "NO" are displayed in the display section 100. If the operator designates to attach a back cover sheet onto the back face of the document copy set, a conditional mode setting screen image 100G for selecting an image formation conditional mode for the back cover sheet is displayed (Steps S8 to S11 in FIG. 4A). This screen includes a message of "SELECT ONE OF BACK COVER CONDITIONAL MODES" and options for the image formation conditions for the back cover sheet which are the same as those for the front cover sheet. On the other hand, if the operator designates not to attach the back cover sheet (Step S12 in FIG. 4A), a chapter setting screen image 100H (which will be described later with reference to FIG. 5H) is displayed.

Though the screen image 100F for determining whether or not a back cover sheet is to be attached as shown in FIG. 5F is displayed in this embodiment, the conditional mode setting screen image 100E shown in FIG. 5E may be switched directly to the conditional mode setting screen image 100G shown in FIG. 5G.

Figure 5H:
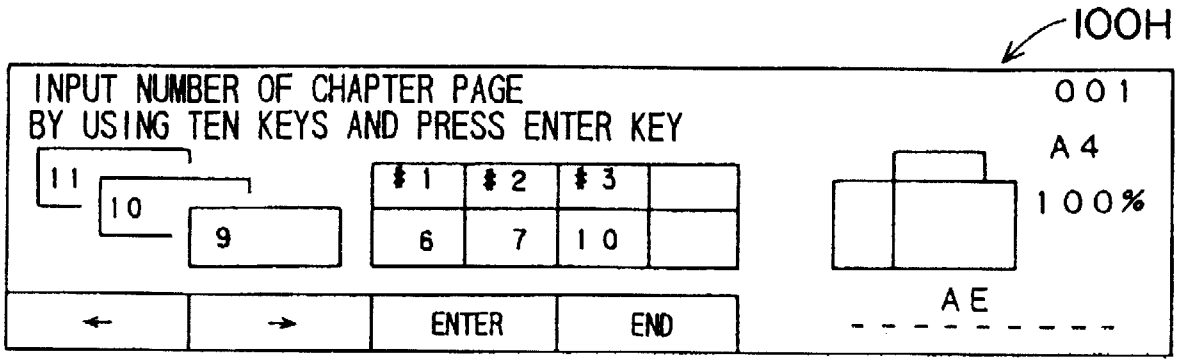

If the operator selects one of the modes in the conditional mode setting screen image 100G for the back cover sheet, the chapter setting screen image 100H shown in FIG. 5H is displayed (Steps S13 and S14 in FIG. 4B). The chapter setting screen image 100H includes a message of "INPUT NUMBER OF CHAPTER PAGE BY USING TEN KEYS AND PRESS ENTER KEY". Thus, the operator is prompted to input the number of a document original page from which a chapter begins (hereinafter referred to as "chapter page"). In the chapter setting screen image 100H, the number of the chapter page is input by using the ten keys 107. After inputting the chapter page number, the operator operates the mode setting key 105 corresponding to the indication of "ENTER" in the screen.

Figure 5I:
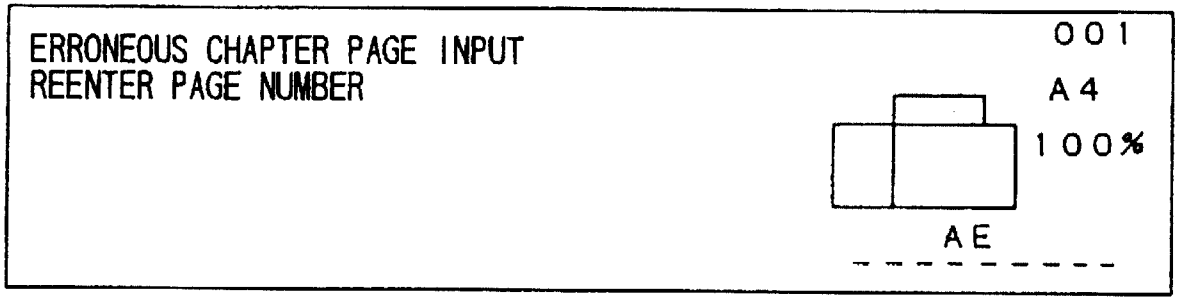

If the input number of the chapter page is erroneous, e.g., if "6" is input for a five-page original document, a message of "ERRONEOUS CHAPTER PAGE INPUT. REENTER PAGE NUMBER" is displayed in the display section 100 as shown in FIG. 5I to prompt the operator to input the chapter page number again.

Figure 5J:
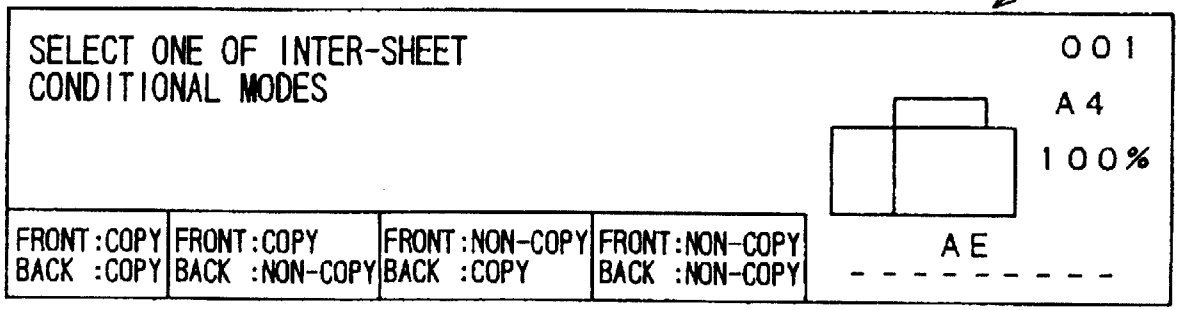

Upon completion of the inputting of the chapter page number, a conditional mode setting screen image 100J for designating image formation conditions for an inter-sheet in the inter-sheet mode is displayed as shown in FIG. 5J (Steps S15 to S19 in FIG. 4B). This screen image includes a message of "SELECT ONE OF INTER-SHEET CONDITIONAL MODES". The options for the image formation conditions for the inter-sheet are the same as those for the front cover sheet or for back cover sheet in the cover mode. More specifically, "FRONT COVER SHEET" or "BACK COVER SHEET" in the corresponding message is replaced with "INTER-SHEET".

Figure 5K:
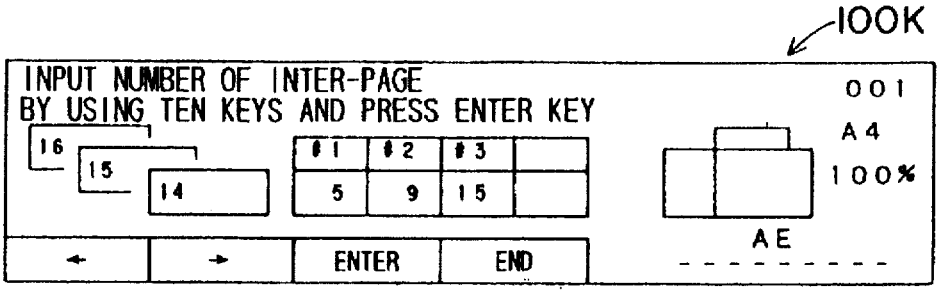
Figure 5L:
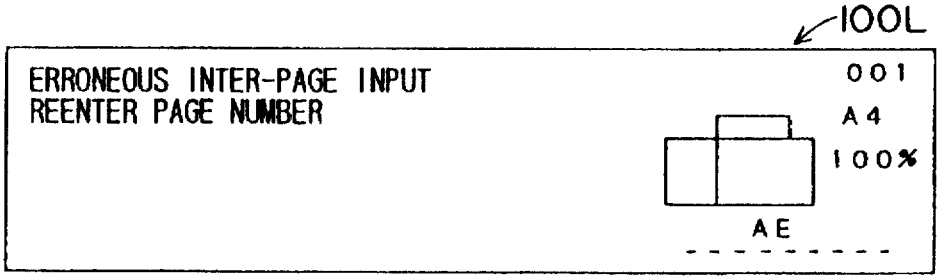

Upon designation of the image formation conditions for the inter-sheet, an inter-sheet setting screen image 100K for inputting the number of a document original page to be copied on an inter-sheet (hereinafter referred to as "inter-page" is displayed as shown in FIG. 5K (Step S20 in FIG. 4B). This screen includes a message of "INPUT NUMBER OF INTER-PAGE BY USING TEN KEYS AND PRESS ENTER KEY". The inter-sheet setting screen image 100K is substantially the same as that of the chapter setting screen image 100H (FIG. 5H). The operator inputs the number of the page to be copied on an inter-sheet by using the ten keys 107, and then operates a mode setting key 105 corresponding to the indication of "ENTER" in the screen.

If the input number for the inter-page is erroneous, a screen image 100L is displayed in the display section 100 which includes a message of "ERRONEOUS INTER-PAGE INPUT. REENTER PAGE NUMBER", as in the case where the input number for the chapter page is erroneous, to prompt the operator to input the inter page number again.

Figure 5M:
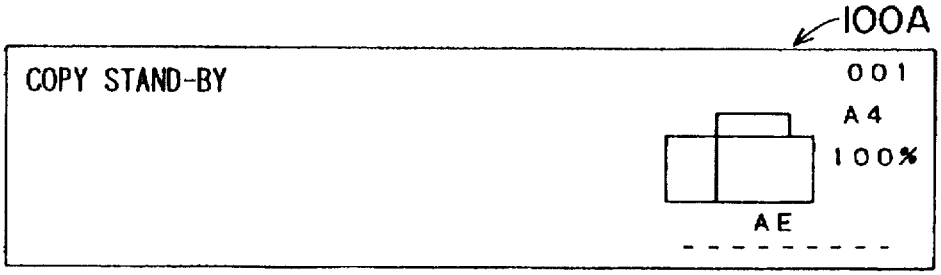

Upon completion of the setting in the sheet mode, the usual copy screen image 100A is displayed as shown in FIG. 5M. By operating the print key 108 in this state, the copying operation in the sheet mode is started.

FIG. 6A to 6E are flow charts for explaining the copying operation to be performed by the copying machine according to this embodiment when the sheet mode is designated. The copying machine controller 80, the RDH controller 87, the sorter controller 88 and the like perform their respective operations in accordance with the predetermined programs stored in their respective ROMs to achieve the copying operation.

In the following description for the flow charts, it is assumed that n two-sided document original sheets (2n pages) are set in the document original sheet setting position 21 in the RDH 2 and an operator designates the following conditions (a) to (g) in the sheet mode:

(a) select "TWO-SIDE COPY MODE" in the mode setting screen image 100B shown in FIG. 5B;

(b) select "TWO-SIDED→TWO-SIDED" (which means that images on the two-sided document original sheets are to be copied on the both sides of copy sheets) in the two-side copy mode setting screen image 100C shown in FIG. 5C;

(c) select "COVER" (cover mode) and "INTER-SHEET" (inter-sheet mode) in the sheet mode setting screen image 100D shown in FIG. 5D;

(d) select "FRONT: COPY, BACK: NON-COPY" (which means that a copy is to be made only on the front side of a front cover sheet) in the conditional mode setting screen image 100E shown in FIG. 5E in the cover mode;

(e) select "NO" (which means that a back cover is not to be attached) in the screen image 100F shown in FIG. 5F;

(f) select "FRONT: COPY, BACK: NON-COPY" (which means that a copy is to be made only on the front side of an inter-sheet) in the conditional mode setting screen image 100J shown in FIG. 5J; and (g) input "k" ($1<k<2n$) for an inter-page number (which means that a document original page k is to be copied on an inter-sheet) in the inter-sheet setting screen image 100K shown in FIG. 5K.

Figure 6A:
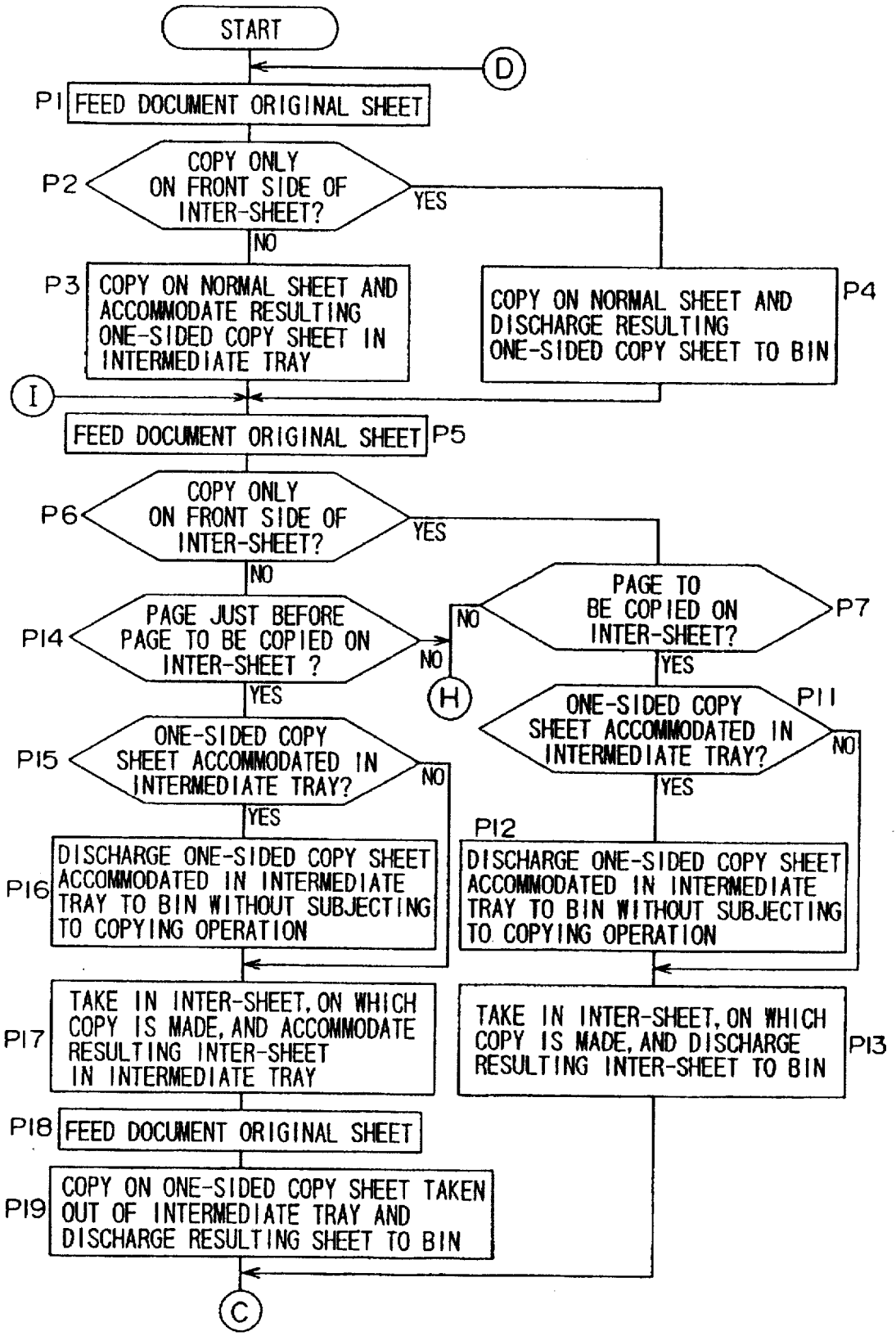
FIGS. 6A to 6E are flow charts for explaining an operation to be performed when a cover-sheet mode and an inter-sheet mode are designated.

Referring to FIG. 6A, when the conditions (a) to (g) are designated and the print key is operated, the n-th document original sheet located at the bottom is taken out of the n document original sheets set in the document original sheet setting position 21 of the RDH 2. The n-th document original sheet is fed to the image formation position J on the document original platform 10 with the back side (page 2n) thereof facing downward (Step P1). At this time, the counter 84 provided in the copying machine controller 80 for counting the number c of fed document original pages is incremented.

When an image on the back side of the document original sheet is to be copied, it is judged whether or not a setting for copying an image only on the front side of an inter-sheet has been made (Step P2). This process is performed to satisfy a requirement that an original image of a page next to the page to be copied on the inter-sheet should not be copied on the back side of the inter-sheet but on a different normal sheet where the two-side copy mode has been selected and the setting for one-sided copy on the front side of the inter-sheet has been made. In this case, since the number of pages following the page to be copied on the inter-sheet is an odd number, a normal sheet on which the last document original page is copied should carry a copy image formed only on one side thereof.

If it is determined in Step P2 that the setting for one-sided copy on the front side of the inter-sheet has been made, the original image on the back side of the document original sheet is copied on a normal sheet, and the resulting one-sided copy sheet is discharged to a bin T (Step P4). On the other hand, if it is determined that the setting for one-sided copy on the front side of the inter-sheet has not been made, the original image on the back side of the document original sheet is copied on a normal sheet, and the resulting one-sided copy sheet is accommodated in the intermediate tray 67 (Step P3). In this embodiment, it is assumed that the setting for one-sided copy on the front side of the inter-sheet is made and, therefore, the process of Step P4 is performed.

Thereafter, the document original sheet after subjected to the copying operation is reversed by the reversing rollers 33 in the RDH 2, and fed again to the image formation position J with the front side thereof facing downward (Step P5). At this time, the counter 84 is incremented to count the number c of document original pages which have been fed so far. In consideration that a sheet discharging control for the inter-sheet is different from a usual sheet discharging control, it is judged which setting has been made, a setting for one-sided copy on the front side of the inter-sheet or a setting for two-sided copy on the both sides of the inter-sheet (Step P6).

Figure 6B:
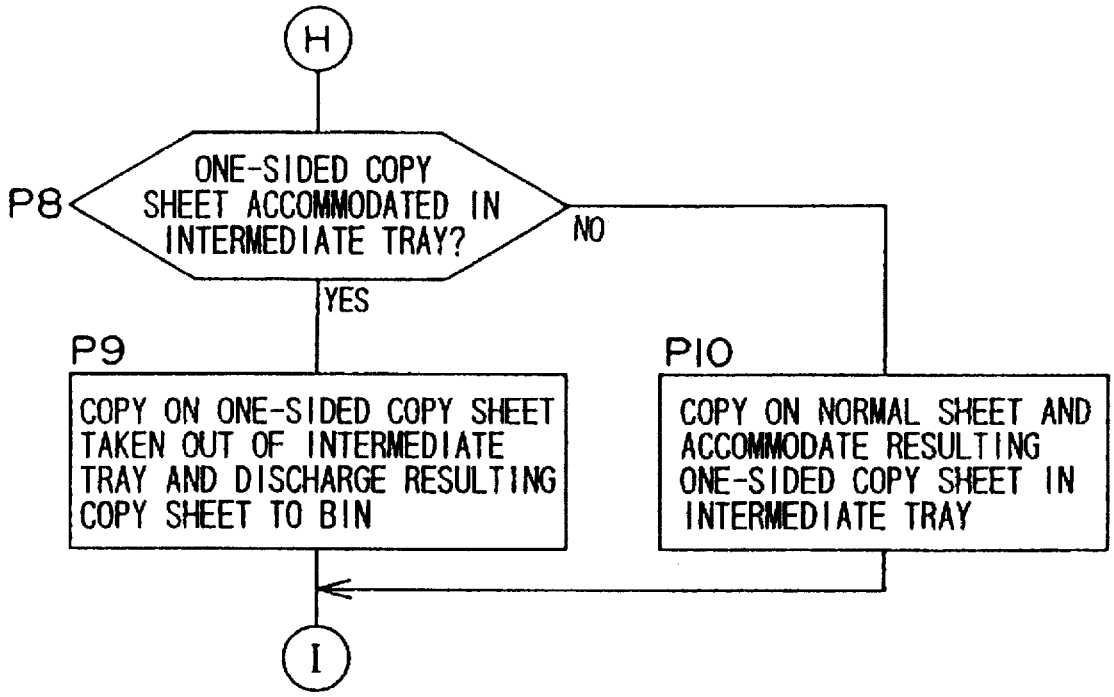

If it is determined that the setting for one-sided copy on the front side of the inter-sheet has been made, it is judged whether or not the number c of document original pages counted by the counter 84 is equal to the number k of the document original page to be copied on the inter-sheet which has been input in the sheet mode setting (Step P7). If it is determined that the number c is not equal to the page number k, the usual two-side copy mode operation is performed as shown in FIG. 6B. More specifically, it is first judged whether or not any one-sided copy normal sheet is accommodated in the intermediate tray 67 (Step P8). If it is determined that there is no such copy sheet, the image on the front side of the original document sheet is copied on a normal sheet fed from one of the decks 53A, 53B, 53C and 54, and the resulting one-sided copy sheet is accommodated in the intermediate tray. 67 (Step P10). On the other hand, if it is determined in Step P8 that a one-sided copy sheet is accommodated in the intermediate tray 67, the image on the front side of the document original sheet is copied on the back side of the one-sided copy sheet taken out of the intermediate tray 67, and the resulting two-sided copy sheet is discharged to one of the bins T (Step P9). In this embodiment, as described above, the one-sided copy sheet carrying the image of the back side of the document original sheet is discharged to one of the bins T and, therefore, the process of Step P10 is performed. The process sequence from Step P5 to Step P10 is repeated until the number c counted by the counter 84 reaches the page number k.

Referring back to FIG. 6A, if it is determined in Step P7 that the number c is equal to the page number k after the process sequence from Step P5 to Step P10 has been repeatedly performed, it is first judged if any one-sided copy normal sheet is accommodated in the intermediate tray 67 (Step P11) to prevent an image of a document original page fed to the image formation position J from being copied on a normal sheet. If no one-sided copy sheet is accommodated, the process directly enters Step P13. On the other hand, if a one-sided copy sheet is accommodated, this one-sided copy sheet is discharged to one of the bins T without being subjected to the copying operation (Step P12), and the process enters Step P13. In Step P13, an inter-sheet set in the manual sheet feeding tray 55 is taken in, on which the image of the document original page k is to be copied, and the resulting inter-sheet is discharged to one of the bins T. Thus, the resulting inter-sheet carries the image of the document original page k formed on the front side (one side) thereof.

On the other hand, if it is determined in Step P6 that the setting for two-side copy on the both sides of the inter-sheet has been made, it is judged whether or not a document original page fed to the image formation position J is a document original page k+1 which is to be copied just before the document original page k which has been input in the sheet mode setting to be copied on the front side of the inter-sheet, thereby judging whether or not the document original page fed to the image formation position J is to be copied on the back side of the inter-sheet (Step P14). If it is determined that the fed document original page is not the document original page k+1 which is to be copied just before the page k, the usual two-side copy mode operation is performed in accordance with the process sequence from Step P8 to Step P10 shown in FIG. 6B.

If it is determined that the fed document original page is the document original page k+1 which is to be copied just before the page k, it is first judged whether or not any one-sided copy normal sheet is accommodated in the intermediate tray 67 (step P15) to prevent the copying operation on a normal sheet. If no one-sided copy sheet is accommodated, the process directly enters step P17. On the other hand, if a one-sided copy sheet is accommodated, this one-sided copy sheet is discharged to one of the bins T without being subjected to the copying operation (Step P16), and the process enters Step P17. In Step P17, an inter-sheet is taken in from the manual sheet feeding tray 55, then the document original page k+1 is copied on the inter-sheet, and the resulting one-sided copy inter-sheet is accommodated in the intermediate tray 67. Thereafter, a document original page to be next copied is fed to the image formation position J (Step P18). The document original page fed to the image formation position J is the document original page k which is input in the sheet mode setting to be copied on the front side of the inter-sheet. The document original page k is copied on the inter-sheet taken out of the intermediate tray 67. Thus, the resulting inter-sheet carries images on the both sides thereof, which is discharged to one of the bin T (Step P19).

Figure 6C:
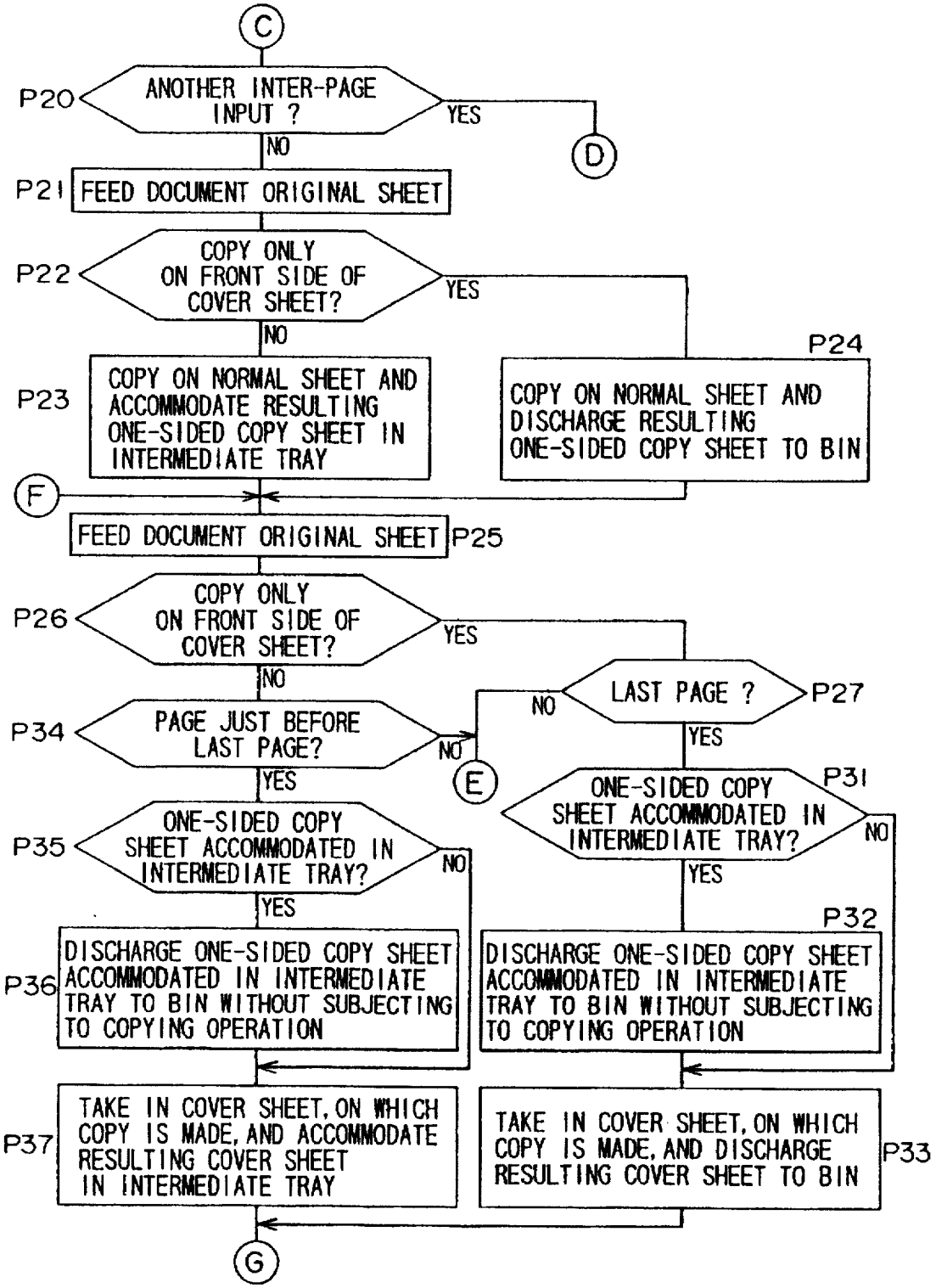
Figure 6D:
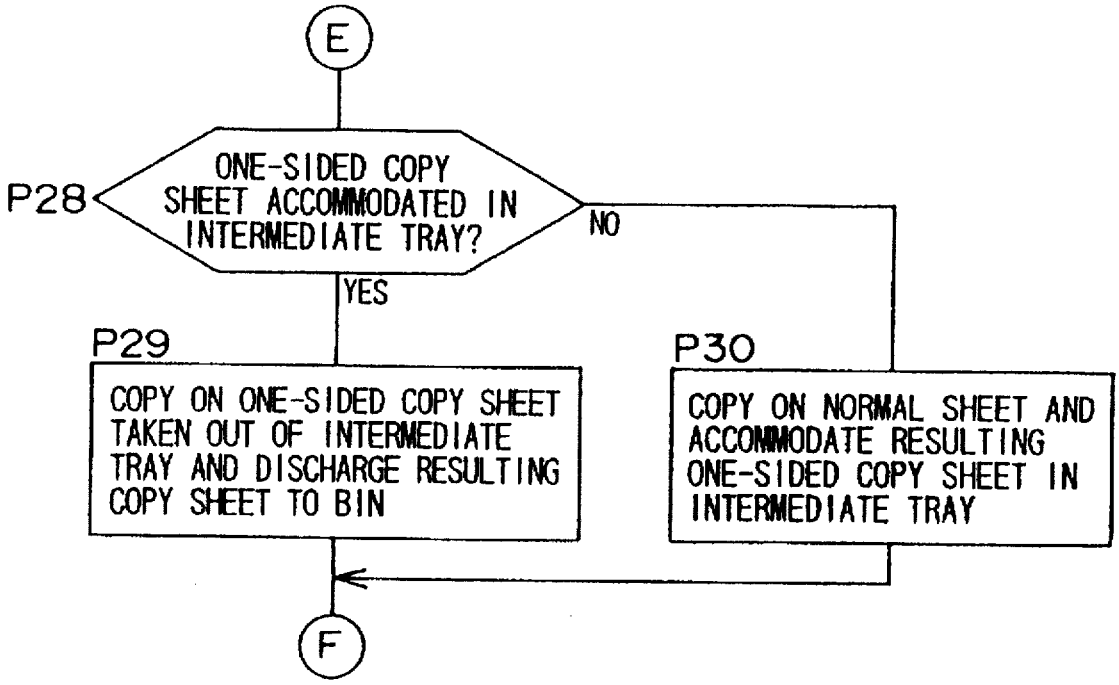
Figure 6E:
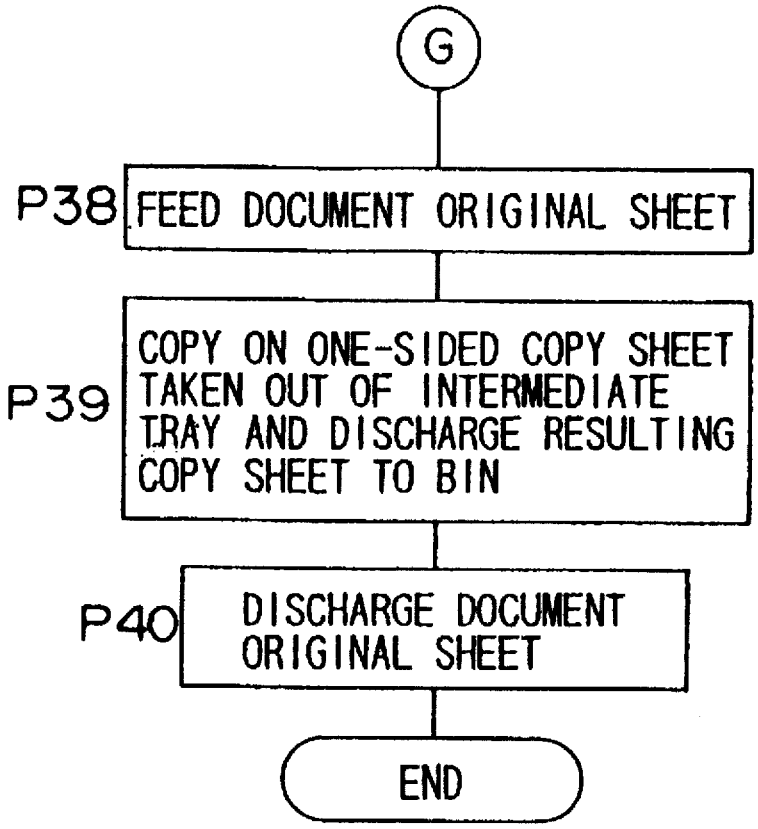

As shown in FIG. 6C, it is judged whether or not another page to be copied on an inter-sheet has been input (Step P20). If it is determined that another inter page has been input, the process sequence from Step P1 to Step P19 shown in FIGS. 6A and 6B is repeated. In this case, the one-side copy operation is performed for a document original page to be copied next to the page copied on an inter-sheet (i.e., document original page just before the inter-page) (Step P4). On the other hand, if no input has been made for another inter-page, the process enters Step P21, and a control for copying on a cover sheet is performed.

In Step P21, a document original page to be next copied is fed to the image formation position J, and the counter 84 is incremented to count the number c of fed document original pages. Then, it is judged whether or not a setting for copying an original image on the front side of a cover sheet has been made (Step P22). If it is determined that the setting for one-side copy on the front side of the cover sheet has been made, an image on the document original page fed to the image formation position J is copied on a normal sheet, and the resulting one-sided copy normal sheet is discharged to one of the bins T (Step P24). This one-side copying operation is done in consideration that the number of residual document original pages is an odd number when a copy is made on one side of the cover sheet. More specifically, the one-side copying operations performed on a page just before the page copied on the inter-sheet.

On the other hand, if it is determined that the setting for one-side copy on the cover sheet has not been made, the original image is copied on a normal sheet, and then the resulting one-sided copy normal sheet is accommodated in the intermediate tray 67 (Step P23).

Thereafter, a document original page to be next copied is fed to the image formation position J (Step P25), and it is judged which setting has been made, a setting for copying an original image on the front side of a cover sheet or a setting for copying original images on the both sides of a cover sheet, in consideration that a cover sheet discharging operation is different from the usual sheet discharging operation (Step P26).

If it is determined that the setting for one-side copy on the front side of the cover sheet has been made, it is judged whether or not a document original page fed to the image formation position J is to be copied on the cover sheet, i.e., whether or not the fed document original page is the last document original page (which means the page to be last copied and corresponds to page 1 of the original document) (step P27). If it is determined that the fed document original page is not the last document original page, the usual two-side copy mode operation is performed in accordance with substantially the same process sequence (Steps P28 to P30 in FIG. 6D) as the process sequence from Step P8 to Step P10 in FIG. 6B. This process sequence is repeated until it is determined in Step P27 that the document original page fed to the image formation position J is the last document original page.

Referring back to FIG. 6C, if it is determined in Step P27 that the fed document original page is the last document original page, it is first judged whether or not any one-sided copy normal sheet is accommodated in the intermediate tray 67 (Step P31) to prevent the document original page from being copied on the normal sheet. If no such copy sheet is accommodated, the process directly enters Step P33. On the other hand, if a one-sided copy sheet is accommodated in the intermediate tray 67, the one-sided copy sheet is discharged to one of the bins T without being subjected to the copying operation (Step P32), and the process enters Step P33. In Step P33, a cover sheet is taken in from the manual sheet feeding tray 55, and the last document original page is copied on the cover sheet. Thus, the resulting cover sheet carries the image copied on the front side thereof.

On the other hand, if it is determined in step P26 that the setting for two-side copy on the both sides of a cover sheet has been made, a copying operation is performed in substantially the same manner as in the case where the setting for two-side copy on the both sides of an inter-sheet has been made.

More specifically, to determine whether or not a document original page fed to the image formation position J is to be copied on the back side of the cover sheet, it is judged whether or not the fed document original page is a document original page (page 2 of the original document) to be copied just before the last document original page (Step P34). If it is determined that the fed document original page is not the one to be copied just before the last page, the usual two-side copy mode operation is performed in accordance with the process sequence from Step P28 to Step P30 shown in FIG. 6D.

Referring back to FIG. 6C, if it is determined that the document original page fed to the image formation position J is the one to be copied just before the last document original page, a cover sheet is taken in from the manual sheet feeding tray 55, then the document original page is copied on the cover sheet, and the resulting one-sided copy cover sheet is accommodated in the intermediate tray 67 (Step P37). Prior to this operation, if a one-sided copy normal sheet is accommodated in the intermediate tray 67 (Step P35), the one-sided copy sheet is discharged to one of the bins T without being subjected to the copying operation (Step P36). Thereafter, the last document original page is fed to the image formation position J (Step P38 in FIG. 6E), and copied on the one-sided copy cover sheet taken out of the intermediate tray 67, and the resulting two-sided copy cover sheet is discharged to one of the bins T (Step P39). Then, the last document original sheet is discharged to complete the copying operation (Step P40).

Figure 7B:
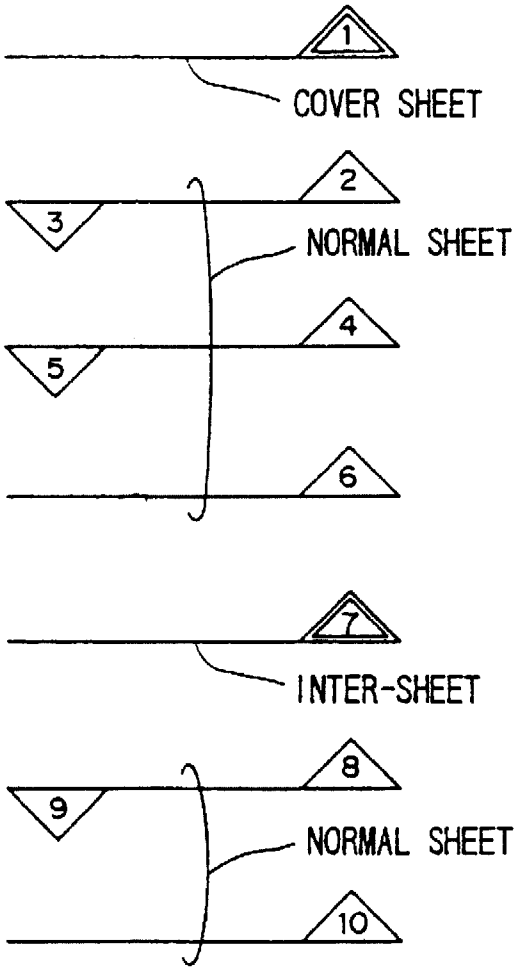
FIGS. 7A and 7B are diagrams for explaining a copying operation to be performed by the copying machine in the sheet mode.
Figure 7A:
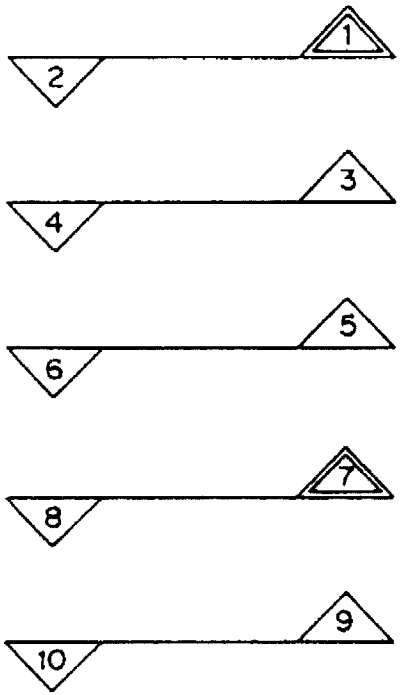
Figure 8A:
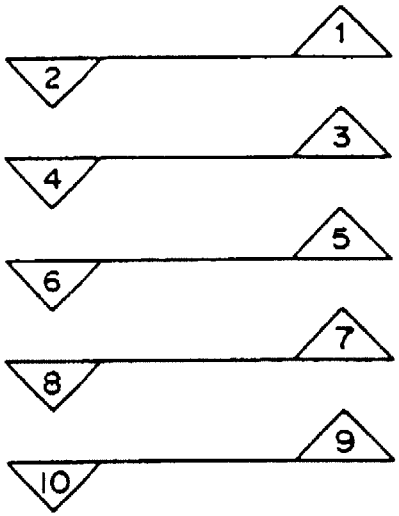
FIGS. 8A to 8C are diagrams for explaining a page shifting process in which, when an image of a page of an original document is formed on one side of a cover sheet or an inter-sheet, the subsequent pages are shifted by one page backward.
Figure 8B:
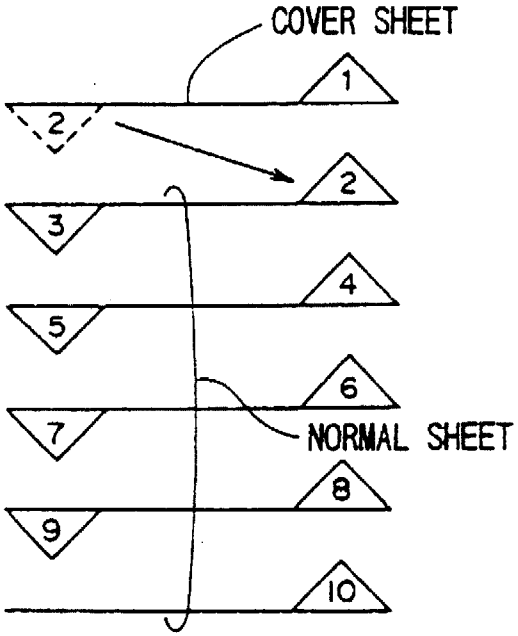
Figure 8C:
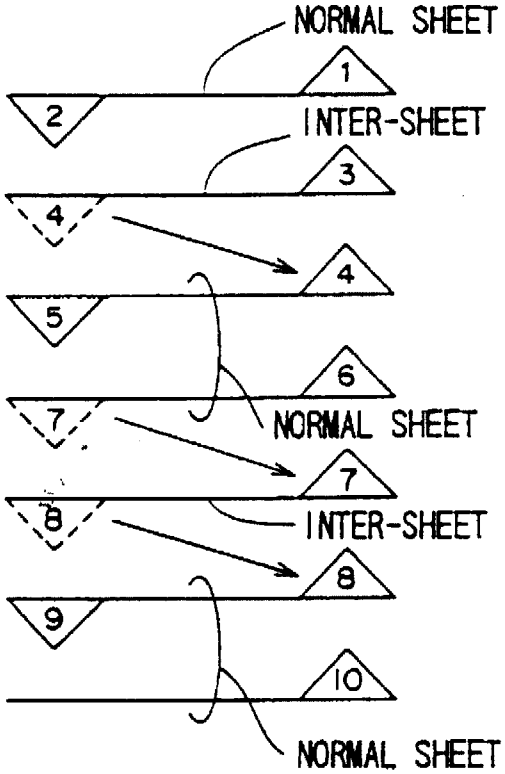
Figure 9A:
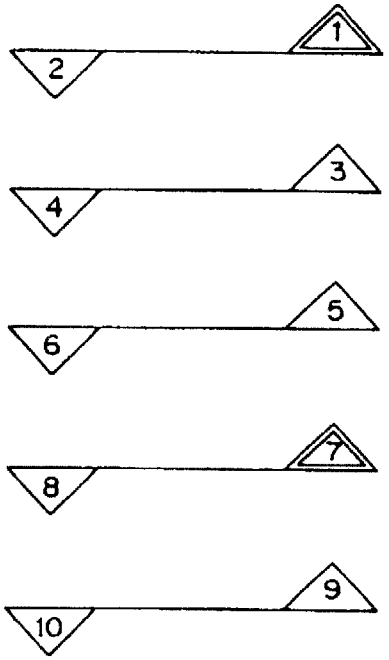
FIG. 9A (PRIOR ART)
FIGS. 9A to 9C are diagrams for explaining copying processes in a conventional cover mode and inter-sheet mode.
Figure 9B:
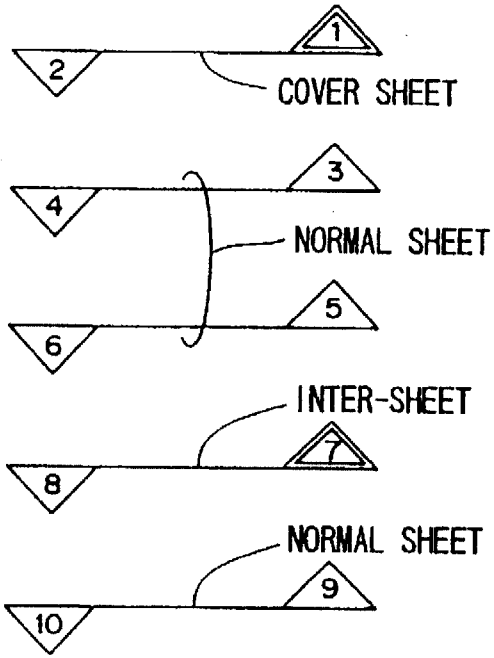
FIG. 9B (PRIOR ART)
Figure 9C:
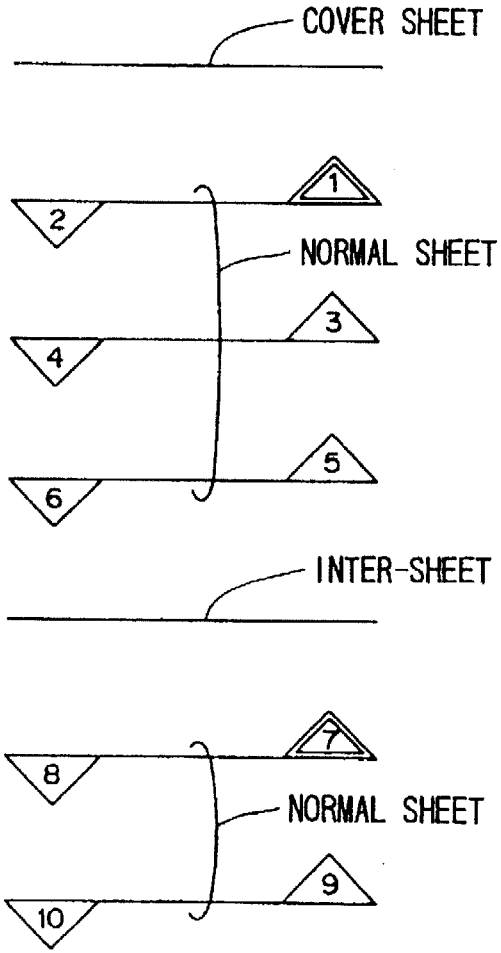
FIG. 9C (PRIOR ART)

FIGS. 7A and 7B are diagrams for explaining the state of a set of document copies prepared by the copying machine according to this embodiment. It is herein assumed that five document original sheets (page 1 to page 10) as shown in FIG. 7*a* are set in the document original sheet setting position 21 on the RDH 2 with page 10 facing downward and the aforesaid conditions (a) to (g) designated in which page 7 indicated by a double triangular mark in FIG. 7A is to be copied on an inter-sheet. In this case, a set of document copies to be finally obtained has a cover sheet carrying an image of page 1 copied on the front side thereof and an inter-sheet carrying an image of page 7 copied on the front side thereof as shown in FIG. 7B.

In accordance with this embodiment, an original image can be copied only on one side of a cover sheet or an inter-sheet. Therefore, a title and a chapter introduction of a document can be respectively copied on the front sides of the cover sheet and inter-sheet, while the text of the document can be copied on the both sides of normal sheets. Therefore, the appearance of the resulting document copy set can be improved.

Further, the one-side copying operation for copying an image on one side of a cover sheet or inter-sheet can be achieved by a simple interactive input operation. Thus, the user interface can be improved.

While the embodiment of the present invention has been described, it should be understood that the present invention is not limited to the aforesaid embodiment. For example, though a two-side copying operation for copying original images of a two-sided document original sheet on the both sides of a copy sheet is explained in the aforesaid embodiment, the present invention can be applied to a case where original images of one-sided document original sheets are to be copied on the both sides of a copy sheet. Further, though the aforesaid embodiment employs a copying machine to explain the present invention, the present invention can be applied to a laser printer and other image forming apparatuses.

Although the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

What is claimed is:

1. An image forming apparatus comprising:

image formation means for forming images on both sides of a recording sheet;

page designation means for designating a page selected from a plurality of pages, each page carrying an image to be formed;

control means for controlling the image formation means to prohibit image formation on one side of a recording sheet carrying an image of the page designated by the page designation means on the other side thereof; and means for prohibiting image formation on one side of a recording sheet carrying an image of a page just before the page designated by the page designation means on the other side thereof.

2. An image forming apparatus as set forth in claim 1, wherein the page designation means includes means for designating a first page selected from the plurality of pages.

3. An image forming apparatus as set forth in claim 1, wherein the page designation means includes means for designating a last page selected from the plurality of pages.

4. An image forming apparatus as set forth in claim 1, wherein the page designation means includes means for designating an intermediate page selected from the plurality of pages.

5. An image forming apparatus as set forth in claim 1, wherein the page designation means is capable of designating a plurality of pages.

6. An image forming apparatus as set forth in claim 1, further comprising:

recording sheet feeding means for selecting either one of a sheet of a first type and a sheet of a second type as a recording sheet on which the image is to be formed, and for feeding the selected sheet to the image formation means;

means for controlling the recording sheet feeding means so as to feed a sheet of the first type if an image on a page other than the page designated by the page designation means is to be formed by the image formation means; and means for controlling the recording sheet feeding means so as to feed a sheet of the second type if the image on the page designated by the page designation means is to be formed by the image formation means.

7. An image forming apparatus as set forth in claim 6, further comprising:

two-side mode designation means for designating a two-side mode for forming images on both sides of a recording sheet; and condition designation means for designating image formation only on one side of a sheet of the second type;

wherein the control means prohibits image formation on one side of the recording sheet carrying the image of the page designated by the page designation means on the other side thereof, if the two-side mode is designated by the two-side mode designation means and the image formation only on one side of the sheet of the second type is designated by the condition designation means.

8. An image forming apparatus as set forth in claim 6, wherein the sheet of the second type includes a cover sheet to be attached onto a first page or a last page of a set of image-carrying sheets.

9. An image forming apparatus as set forth in claim 6, wherein the sheet of the second type includes an inter-sheet to be inserted into a middle page portion of a set of image-carrying sheets.

10. An image forming apparatus as set forth in claim 1, wherein the control means includes means for controlling the image formation means to form images on both sides of a recording sheet when image formation is performed on a page other than the page designated by the page designation means.

11. An image forming apparatus as set forth in claim 1, wherein the image formation means forms images of the plurality of pages on recording sheets in a descending order from the last page, the apparatus further comprising means for prohibiting image formation on one side of a recording sheet carrying an image of the last page formed on the other side thereof.

12. An image forming apparatus as set forth in claim 1, wherein the image forming apparatus is a copying machine, the apparatus further comprises document original feeding means for successively presenting a front side and a back side of each two-sided document original sheet to a document original presentation portion, and the image formation means forms a copy image of a document original presented to the document original presentation portion.

13. An image forming apparatus comprising:

image forming means for forming an image on a recording sheet which is capable of forming images on both sides of a recording sheet;

means for setting a normal sheet two-sided image forming mode in which a normal sheet is used as a recording sheet and the image forming means is allowed to form images on both sides of the normal sheet;

means for setting a special sheet mode in which a special sheet different from a normal sheet is used as a recording sheet and the image forming means is controlled such that an image is formed on a selected side of the special sheet;

means for selecting and setting an image formed side of a special sheet on which an image is to be formed;

control means, including means for causing the image forming means to form images of both sides of a two-sided original sheet onto both sides of a recording sheet, respectively, and means for causing the image forming means to form an image of one side of a two-sided original sheet on one side of a recording sheet while forming an image of the other side of the two sided-original sheet on one side of another recording sheet, the controlling means causing the image forming means, when the normal sheet two-sided image forming mode and the special sheet made are both set, to form desired images on a normal sheet and a selected side of a special sheet by preliminarily determining, for each normal sheet, that the normal sheet should carry an image on either side or both sides thereof, while giving priority to the special sheet mode with respect to the normal sheet two-sided image forming mode so that a desired image is formed on a selected side of a special sheet.

14. An image forming apparatus, comprising:

image forming means for forming an image on a recording sheet, which is capable of forming images on both sides of a recording sheet;

means for setting a two-sided image forming mode in which the image forming means is allowed to form images on both sides of a recording sheet;

means for setting a special mode in which the image forming means is controlled to form an image on one side of a designated recording sheet, while the other side of the designated recording sheet is prevented from carrying an image formed by the image forming means;

first controlling means for causing the image forming means to form an image of one side of a two-sided original sheet onto one side of a recording sheet which is designated to be subjected to image forming in the special mode;

second controlling means for causing the image forming means to form an image of one side of a two-sided original sheet onto one side of a recording sheet which is not designated to be subjected to image forming in the special mode;

third controlling means for causing the image forming means to form images of both sides of a two-sided original sheet onto both sides of a recording sheet which is not designated to be subjected to image forming in the special mode; and fourth controlling means for causing the image forming means to form images of respective sides of a two-sided original sheet onto both sides of a recording sheet which is not designated to be subjected to image forming in the special mode;

whereby the image forming means forms images of each of two-sided original sheets onto one side of each of two recording sheets or both sides of one recording sheet.

15. An image forming apparatus, comprising:

image forming means for forming an image on a recording sheet, which is capable of forming images on both sides of a recording sheet;

means for setting a two-sided image forming mode in which the image forming means is permitted to form images on both sides of a recording sheet;

means for setting a special mode in which the image forming means is controlled to form an image on one side of a designated recording sheet, while the other side of the designated recording sheet is prevented from carrying an image formed by the image forming means; and controlling means for causing the image forming means to form images of both sides of one two-sided original sheet onto one side of each of two recording sheets, one of the two recording sheets being designated to be subjected to image forming in the special mode, and the other of the two recording sheets not being designated to be subjected to image forming in the special mode.

* * * * *